US006206345B1

(12) United States Patent
Lenahan et al.

(10) Patent No.: US 6,206,345 B1
(45) Date of Patent: Mar. 27, 2001

(54) PIPE PUSHER

(75) Inventors: Lawrence M. Lenahan, Westlake, OH (US); Bernam G. Fraley, Clinton, MI (US); Mark R. Kaletta, Shreve, OH (US); David E. Koehmstedt, Jr., Hoover, AL (US)

(73) Assignee: McNally Tunneling Corporation, Westlake, OH (US)

( * ) Notice: Subject to any disclaimer, the term of this patent is extended or adjusted under 35 U.S.C. 154(b) by 0 days.

(21) Appl. No.: 09/253,340

(22) Filed: Feb. 19, 1999

(51) Int. Cl.[7] ..... E21B 19/00
(52) U.S. Cl. ..... 254/29 R; 254/95
(58) Field of Search ..... 254/95, 96, 97, 254/84, 85, 29 R, 30; 405/154, 184

(56) References Cited

U.S. PATENT DOCUMENTS

| | | | | |
|---|---|---|---|---|
| 199,640 | | 1/1878 | Haas et al. . | |
| 1,117,150 | * | 11/1914 | Ammon | 254/29 R |
| 1,442,164 | | 1/1923 | Ludlum et al. . | |
| 1,635,617 | * | 7/1927 | Hall | 254/85 |
| 1,962,228 | | 6/1934 | Abramson et al. . | |
| 2,209,660 | | 7/1940 | Oka . | |
| 2,656,148 | | 10/1953 | Fladung . | |
| 2,991,974 | | 7/1961 | Bingham . | |
| 3,645,502 | | 2/1972 | Stromp, Jr. . | |
| 3,711,064 | | 1/1973 | Kielczewski . | |
| 3,807,695 | | 4/1974 | Gremillion et al. . | |
| 3,907,253 | | 9/1975 | Schosek . | |
| 3,966,169 | | 6/1976 | Schosek . | |
| 3,988,003 | | 10/1976 | Schosek . | |
| 3,988,004 | | 10/1976 | Schosek . | |
| 4,159,819 | * | 7/1979 | Bargel et al. | 254/29 R |
| 4,160,538 | * | 7/1979 | Armstrong | 254/95 |
| 4,329,077 | | 5/1982 | Boupion . | |
| 4,746,096 | | 5/1988 | Donnell et al. . | |

* cited by examiner

*Primary Examiner*—Robert C. Watson
(74) *Attorney, Agent, or Firm*—Thompson Hine & Flory LLP

(57) ABSTRACT

An apparatus for pushing tubular members along a tunnel, the apparatus comprising a frame shaped to receive a tubular member therein and having an open end shaped to receive the tubular member therethrough, and a pushing element mounted on and displaceable along the frame for engaging a tubular member within the frame and pushing the tubular member along the frame and through the open end. The apparatus further includes a drive motor mounted on the pushing element and engaging the frame, the drive motor displacing the pushing element along the frame relative to the open end.

29 Claims, 9 Drawing Sheets

PIPE PUSHER

The present invention is directed to an apparatus and method for installing a pipe, and more particularly, to an apparatus and method for progressively pushing pipe segments through a preexisting hole to thereby install a pipe.

BACKGROUND OF THE INVENTION

When installing gas lines, water lines, sewer lines and the like, a pipe pusher is typically used to push a series of pipe segments through a generally horizontally extending hole or tunnel below ground level. Each sequentially installed pipe segment is connected to an adjacent pipe segment to form the pipeline. A pipe pusher may also be used to install a piping system inside a preexisting gas, sewer or water lines, in which case the pipe segments are pushed inside the preexisting pipelines. In either case, in order to gain access to the hole in which the pipe is to be installed, a generally vertically extending shaft is excavated down to the elevation of the hole. The shaft is typically circular in diameter, and is large enough to allow workmen and equipment access to the hole.

Once access to the hole is established, various methods may be utilized for pushing the pipe into the hole. For example, a backhoe anchored at ground level may extend into the shaft, and may be manually operated to grip and push the pipe segments into the hole. However, because the backhoe is located remotely from the pipe and must be operated at awkward angles, its efficiency is limited. It is more desirable to utilize a pipe pusher that can be located within the shaft at the same elevation as the installed pipe. In one such embodiment, a reciprocating hydraulic or pneumatic piston/shaft combination is used to push the pipe into the tunnel. However, when the piston of such a pipe pusher is in its withdrawn (retracted) position, substantial clearance is required behind the pipe pusher to accommodate the withdrawn piston. This requires a shaft that is increased is size to accommodate the piston, which adds to the time and expense of the installation operation. In reduce the required space in the shaft, pipe pushers utilizing a variety of ropes, wires, belts, and/or chains and pulleys have been developed that push or pull the pipe into the tunnel. The wire and pulley arrangement eliminates the need for substantial clearance behind the pipe pusher frame. However, the various wires and pulleys are complex to set up and operate, and can bind or become untracked relatively easily.

Furthermore, it often desired change the direction in which the pipe is being pushed. For example, there may be a second hole or tunnel within the shaft that is about 180 degrees apart from the hole into which pipe is being pushed. In order to push pipe in this second hole, most existing pipe pushers must be lifted by a crane and rotated about 180 degrees in the shaft so that the pipe pusher is properly oriented to push pipe in the second hole. However, this process is difficult and time consuming.

Accordingly, there is a need for a pipe pusher which can fit into a shaft and is relatively compact, which is robust and reliable in operation, and which can push pipe in two, opposed directions.

SUMMARY OF THE INVENTION

The present invention is a pipe pusher for pushing a pipe or other member into a tunnel. The pipe pusher of the present invention utilizes a rack and pinion mechanism for driving a pushing element that engages and pushes the pipe into the tunnel. The rack and pinion arrangement provides a relatively compact pipe pusher that reduces the space required in the shaft, and is reliable and robust. Furthermore, the rack and pinion mechanism can be mounted to either end of the pipe pusher frame, which allows the pipe pusher to install pipe in two opposed directions without having to adjust the location of the frame.

In particular, the present invention is an apparatus for pushing tubular members along a tunnel, the apparatus comprising a frame shaped to receive a tubular member therein and having an open end shaped to receive the tubular member therethrough, and a pushing element mounted on and displaceable along the frame for engaging a tubular member within the frame and pushing the tubular member along the frame and through the open end. The apparatus further includes a drive motor mounted on the pushing element and engaging the frame, the drive motor displacing the pushing element along the frame relative to the open end. Other objects and advantages of the present invention will become apparent from the following description, the accompanying drawings and the appended claims.

DETAILED DESCRIPTION

Figure 1:
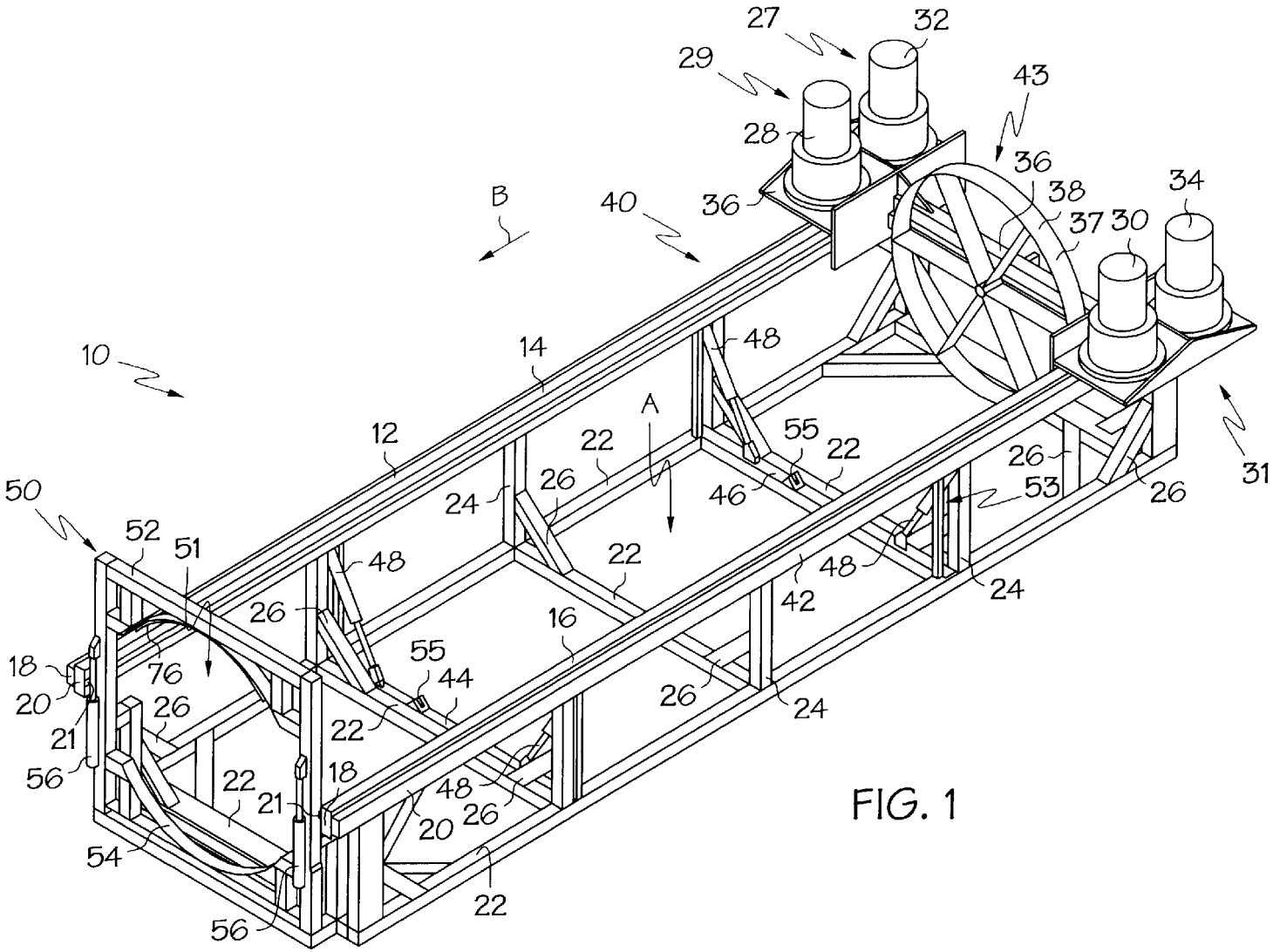
FIG. 1 is a perspective view of the pipe pusher of the present invention.
Figure 2:
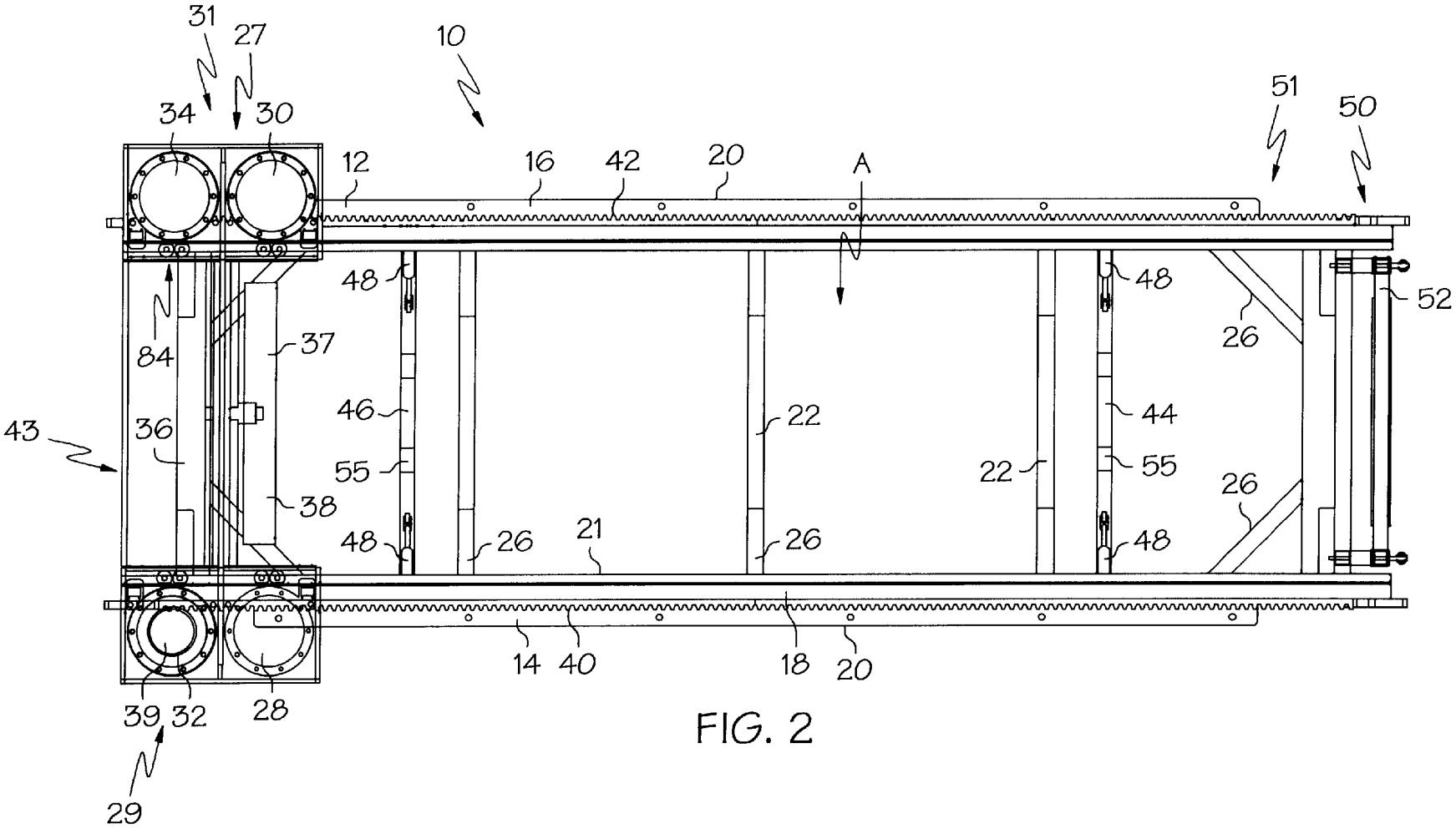
FIG. 2 is a top view of the pipe pusher of FIG. 1.

As best shown in FIGS. 1–4 the present invention is a pipe pusher 10 including a frame 12 which receives a pipe or other member in the longitudinal space indicated at A. The frame 12 includes a pair of laterally spaced, longitudinally extending sidebars 14, 16. Each sidebar 14, 16 includes a raised, central bar 18, an outer rail 20, and an inner rail 21. The frame 12 further includes a plurality of bottom support members 22, and a plurality of vertical support members 24 extending between the bottom support members 22 and the sidebars 14, 16. A series of trusses 26 interconnect the vertical support members 24, the bottom support members 22, and the sidebars 14, 16 together to lend stiffness to the frame 12. The frame 12 includes a distal end, or open end, 51, which is shaped to allow a pipe member to pass therethrough.

The pipe pusher 10 includes a pushing element 38 that includes push ring 37 and a carriage 36. A drive motor 27 is supported on the carriage 36. The drive motor 27 includes a first set of motors 29 comprising a first motor 28 and a third motor 32. The drive motor 27 also includes a second set of motors 31 including a second motor 30 and fourth motor 34. The motors 28, 30, 32, 34 may be of any type that provide the desired output, such as a Variable Displacement Motor, type AA6VM, manufactured by Rexroth Hydraulics of Germany. The push ring 37 is coupled to the center of the carriage 36. The push ring 37 is generally circular in end view, and includes a plurality of spokes 33 (FIG. 4). Each motor 28, 30, 32, 34 has a gear or pinion 39 (FIG. 3) extending from the bottom of the motor that is rotationally driven by the motor. The gears driven by the first motor 28 and the third motor 32 are received in a first longitudinally extending rack 40 that extends along the first sidebar 14. The gears driven by the second 30 and fourth 34 motors are received in a second longitudinally extending rack 42 that extends along the second sidebar 16 (FIG. 3).

Figure 5:
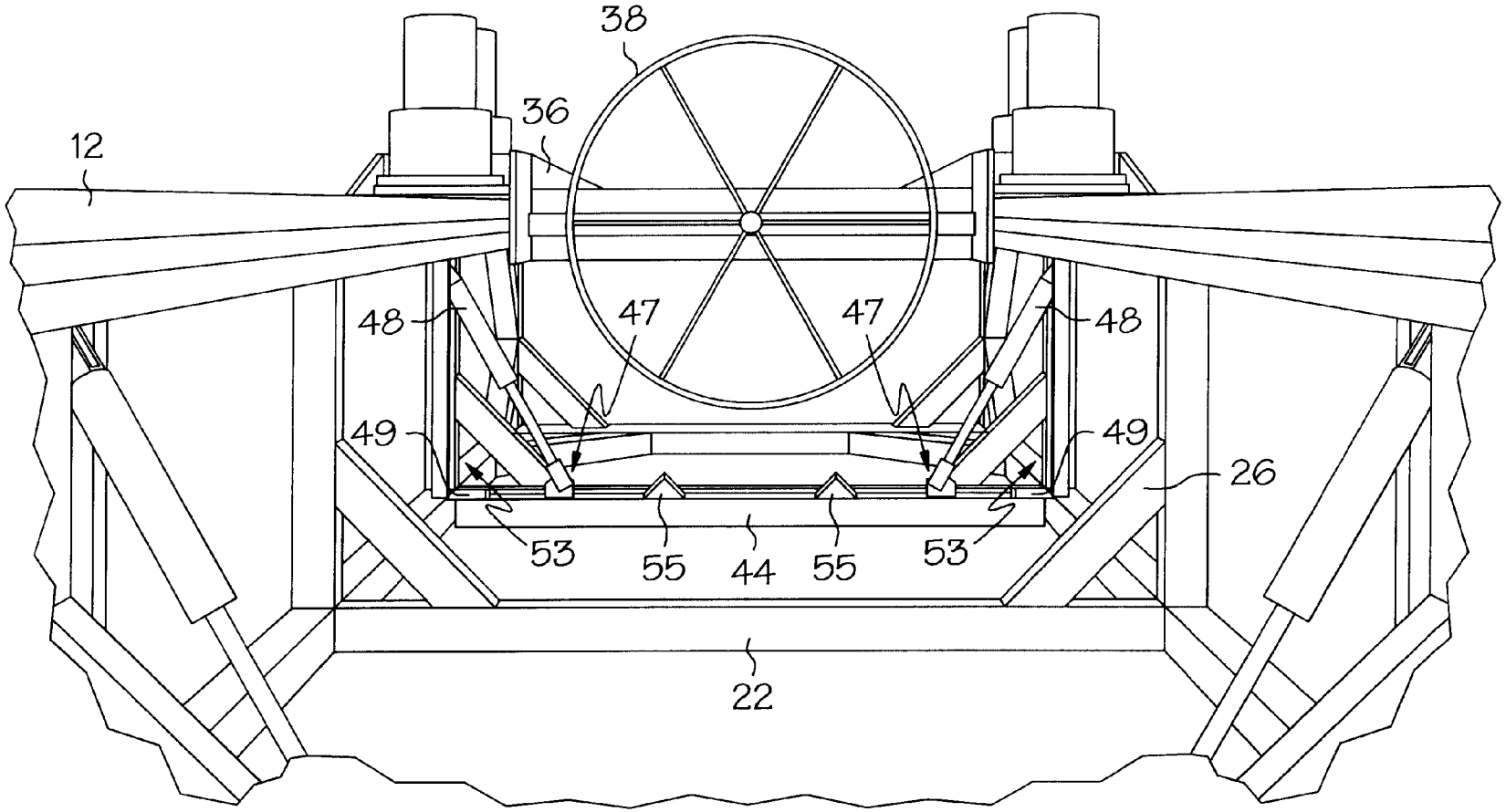
FIG. 5 is a partial perspective end view of the pipe of FIG. 1.

A first lift bar 44 and a second lift bar 46 are located along the bottom of the frame 12 (FIG. 1). As best shown in FIG. 5, the lift bar 44 includes a pair of extensions 49 that are received in a pair of slots 53. The lift bar 44 is coupled to a lift hydraulic ram 48 at each end thereof by means of a pivotable connection 47. Each lift hydraulic ram 48 is coupled to the frame 12, and the lift bars 44, 46 are vertically moveable by the contraction of the lift hydraulic rams 48. As the lift hydraulic rams 48 contract, the lift bar 44 is moved vertically upward, guided by the slots 53. The components and operation of the lift bar 46 are substantially the same as the lift bar 44.

Returning to FIG. 1, an end clamp 50 is located at the distal end 51 of the frame 12, and includes a top portion 52 and a bottom portion 54 that are vertically displaceable relative each other. In the illustrated embodiment, the top portion 52 is movable relative the bottom portion 54 via a motor in the form of pair of end hydraulic rams 56.

Figure 3:
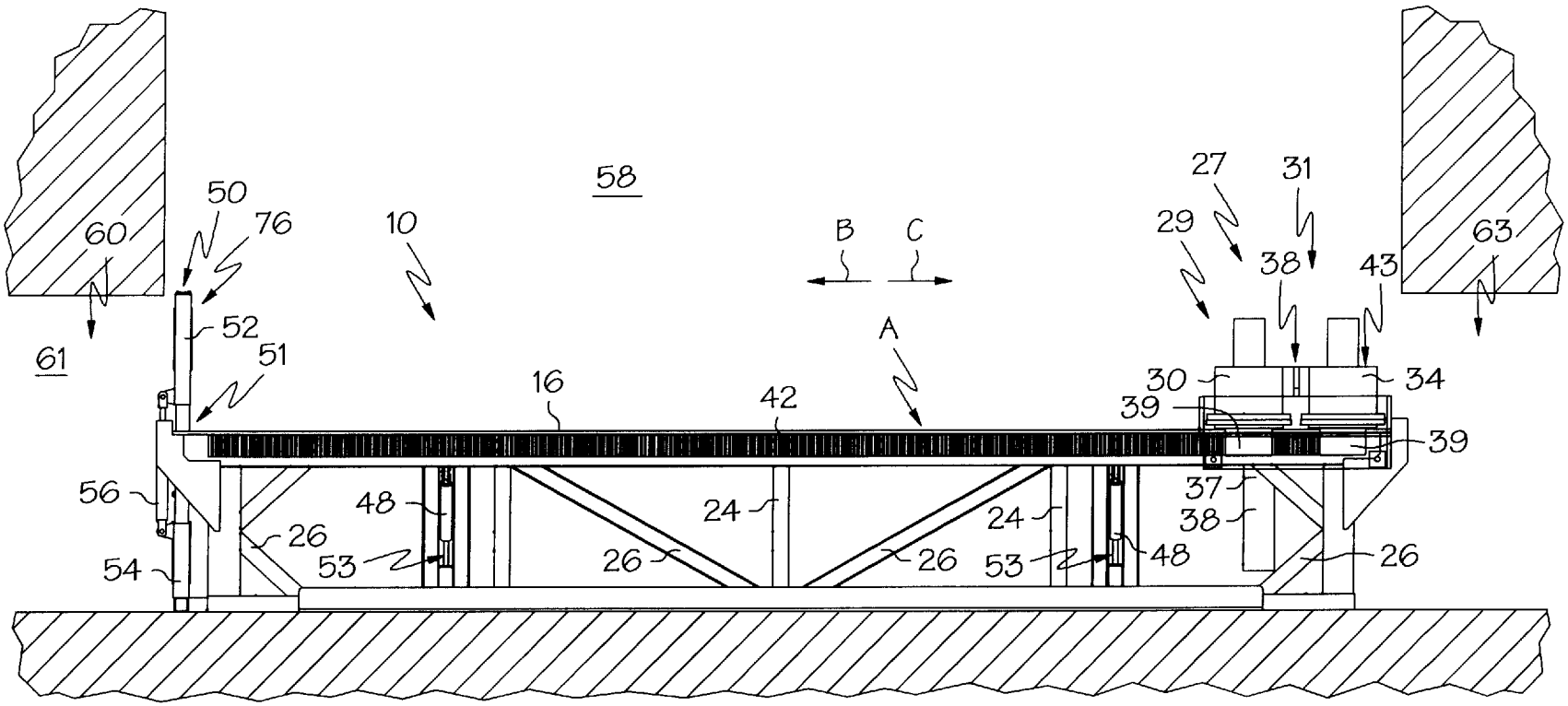
FIG. 3 is a side view of the pipe pusher of FIG. 1, shown at the bottom of a shaft.
Figure 4:
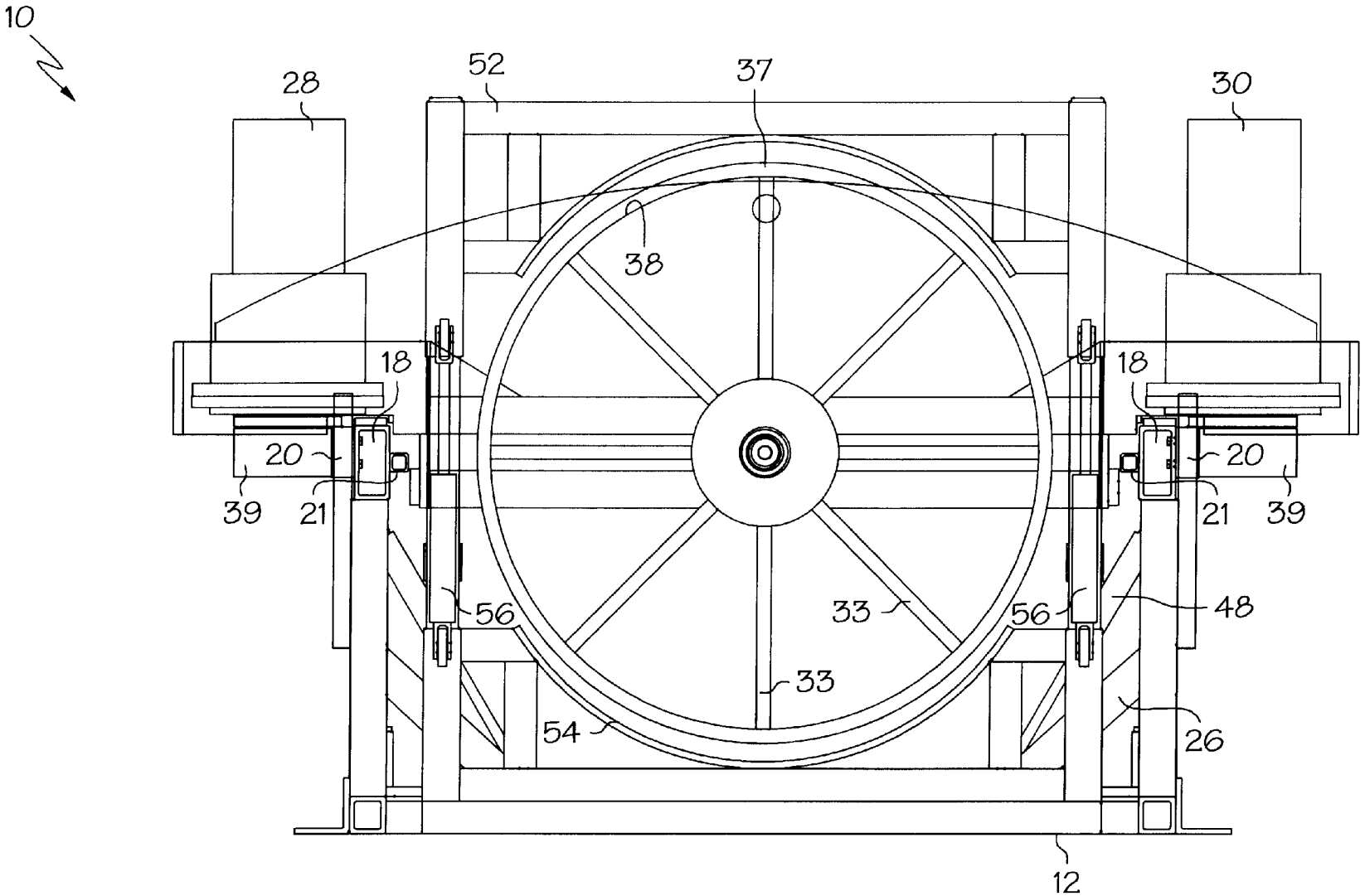
FIG. 4 is an end view of the pipe pusher of FIG. 1.

As shown in FIG. 3, in operation the pipe pusher 10 is lowered into the shaft 58 and the distal end 51 is aligned with the tunnel opening 60 into which a pipe is to be inserted. A pipe (not shown) is then placed in the longitudinally extending space indicated at A. In order to push the pipe into the tunnel opening 60, the first 28, second 30, third 32 and fourth 34 motors rotate their respective gears 39. In the embodiment shown in FIG. 1, the first motor 28 and third motor 32 rotate their gears counterclockwise, and the second motor 30 and fourth motor 34 motors rotate their gears clockwise to cause the motors 28, 30, 32, 34 and carriage 36 to move down the frame 12 towards the end clamp 50. As the carriage 36 moves towards the end clamp 50 in the downstream direction (indicated by the arrow B), the pushing element 38 is also moved in the downstream direction. It should be understood that other methods for converting the output of the gears 39 to the movement of the carriage may be used without departing from the scope of the invention. For example, if sufficient frictional forces can be attained, a beveled roller urged along a generally flat surface may be used in place of the gear 39 and racks 40, 42. However, the output of the drive motor 27 is preferably directly coupled to the pushing element 38 and/or frame 12 in order to cause relative motion between the pushing element and frame. Because the output is provided directly to the pushing element 38 and/or frame 12, and no pulleys or wires are required to transmit power, and the pipe pusher 10 is easier to operate and avoids the problems of having to maintain the alignment of wires, belts, or pulleys.

With continued movement, the pushing element 38 engages a first end of the pipe and the motors 28, 30, 32, 34, carriage 36 and pushing element 38 move the pipe in the downstream direction. Continued movement of the pushing element 38 urges the pipe into the opening 60 of the tunnel 61, and ultimately into the desired position in the tunnel 61. A pair of centering guides 55 are located on each lift bar 44, 46 (FIG. 5) to keep the pipe centered in the frame 12 as it moves in the downstream direction. Once the pipe is pushed into the tunnel 61, the rotation of the gears 39 is reversed by the motors 28, 30, 32, 34, and the pushing element 38, rack 36, and motors 28, 30, 32, 34 move upstream along the frame 12. Once the rack 36 reaches the position shown in FIGS. 1–4, the pipe pusher 10 is reset and ready to accept another pipe for insertion into the tunnel opening 60.

Figure 6:
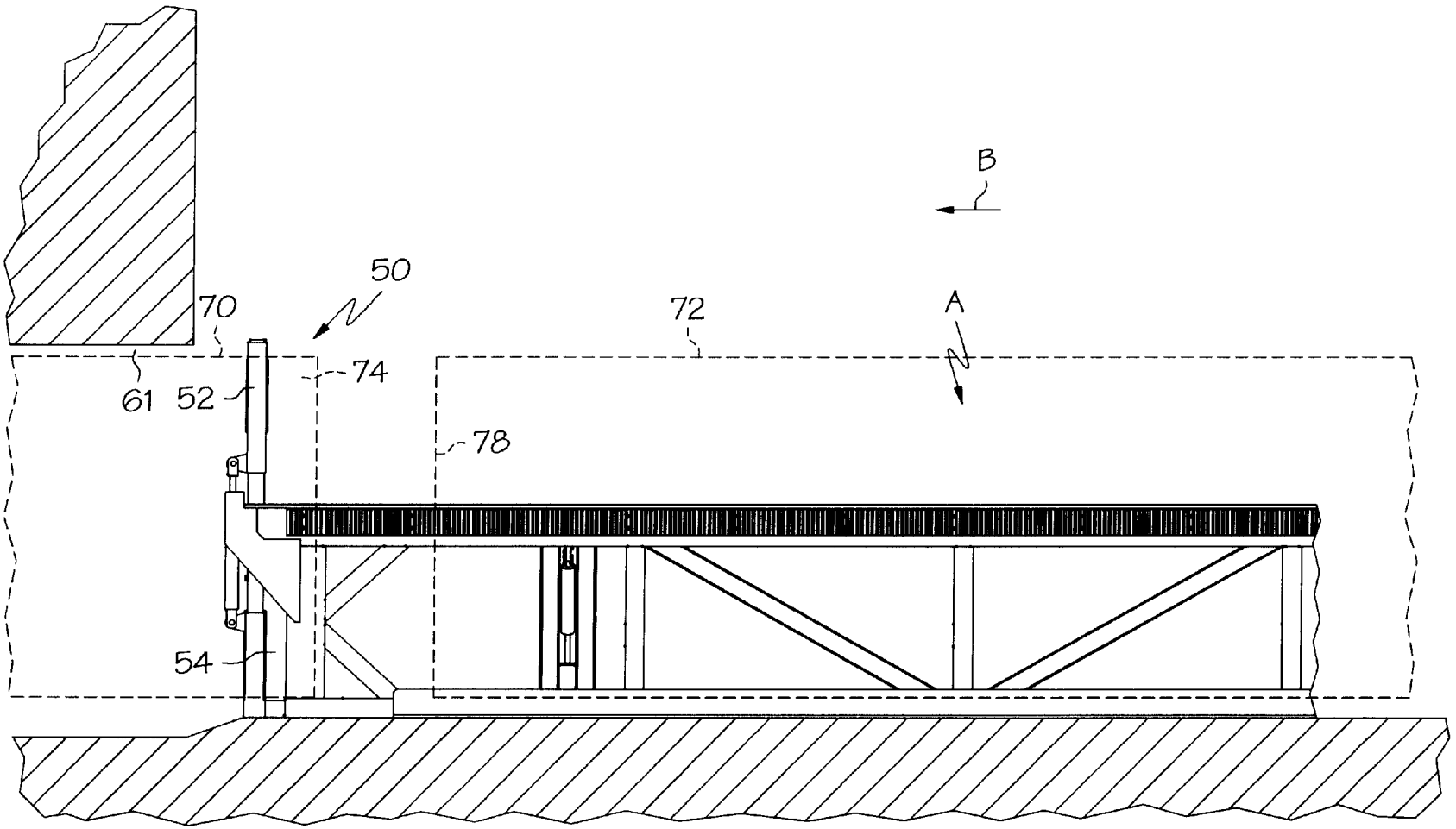
FIG. 6 is a partial end view of the pipe pusher of FIG. 1, shown at the bottom of a shaft and receiving a pair of pipes therein, the pipes shown in hidden lines.

With reference to FIG. 6, the end clamp 50 of the pipe pusher 10 may be used to couple a pipe 70 that is already substantially located inside the tunnel 61 to a pipe 72 that is about to be pushed into the tunnel 61. For example, once a pipe 70 is pushed substantially downstream of the frame and nearly completely into the tunnel 61 (the "downstream pipe"), the pushing element 38 may be withdrawn such that the second end 74 of the pipe 70 is resting on the bottom portion 54 of the end clamp 50. Next, the top portion 52 of the end clamp 50 is moved down into engagement with the second end 74 of the downstream pipe 70. The flange 76 of the top portion 52 (FIG. 1) enables the end clamp 50 to accommodate pipes of various sizes. Once the end clamp 50 has clamped the downstream pipe 70, another pipe 72 (the "upstream pipe") may be placed into the space A. The pushing element 38 is moved into contact with the upstream pipe 72 and urges the pipe 72 in the downstream direction B.

The ends (74, 78) of the downstream pipe 70 and the upstream pipe 72 each include fittings, o-rings, or prefabricated geometries to allow them to sealingly fit together when urged into contact with sufficient force. Thus, the first end 74 of the downstream pipe 70 is mated with the second end 78 of the upstream pipe 72. As the upstream pipe 72 is moved downstream by the pushing element 38, the lift bars 44 may be moved vertically upward to lift the first end 78 of the upstream pipe 72 into the desired position to ensure the upstream pipe 72 properly mates with the downstream pipe 70.

Once the mating ends 78, 74 of the upstream 72 and downstream 70 pipe are properly aligned (i.e. generally concentric), the pushing element 38 pushes the upstream 72 and downstream 70 pipe into sealing engagement. The end clamp 50 holds the downstream pipe 70 in position while they are mated. After the upstream 72 and downstream pipes 70 are properly engaged, the end clamp 50 is released, and the pushing element 38 continues to move in the downstream direction to push both pipes 70, 72 into the tunnel 61. After the pushing element 38 has completed its stroke, if desired, the second end (not shown) of the newly inserted pipe 72 may be located on the bottom portion 54 of the end clamp 50, so that the subsequently inserted pipe may be mated thereto in the same manner described above.

The pipe pusher may also be adapted to push pipe in the opposite direction (i.e. the upstream direction C shown in FIG. 3) without having to adjust the location of the frame 12. For example, a pipe may be pushed into the tunnel opening 63 that is located about 180 degrees opposite the tunnel opening 60. In this case, the pipe is pushed through a second open end 43 that is located on the frame 12 opposite the distal end 51. In order to push the pipe through the second open end 43, the motor 27 is moved to the distal end 51 of the frame 12. The push ring 37 is next uncoupled from the carriage 36 and mounted on the opposite side of the carriage 36. The pipe pusher 10 may then accept a pipe in the space indicated at A, and push it through the second open end 43 in the direction C into the tunnel opening 63. If an end clamp 50 is being used, it too may be uncoupled from the frame 12, and moved to the end of the frame 12 adjacent the tunnel opening 63. In this manner, the pipe pusher 10 may be quickly and easily adapted to push pipe in an opposite direction from an existing set up, without having to rotate the frame 12. When the pushing element 38 is adjacent the distal, or open end 51 when the pipe pusher 10 is in the orientation shown in FIG. 3, a pipe can be received in the space A. This enables the pipe pusher 10 to push pipe in either orientation. This is not possible, for example, with pipe pushers that utilize a piston, as the extended piston would block the placement of a pipe in the space A. Furthermore, because the motor 27 travels with the pushing element 38, strong pushing forces can be generated while pushing in either the upstream or downstream directions, and strong pushing forces are generated during the entire pushing stroke.

Figure 7:
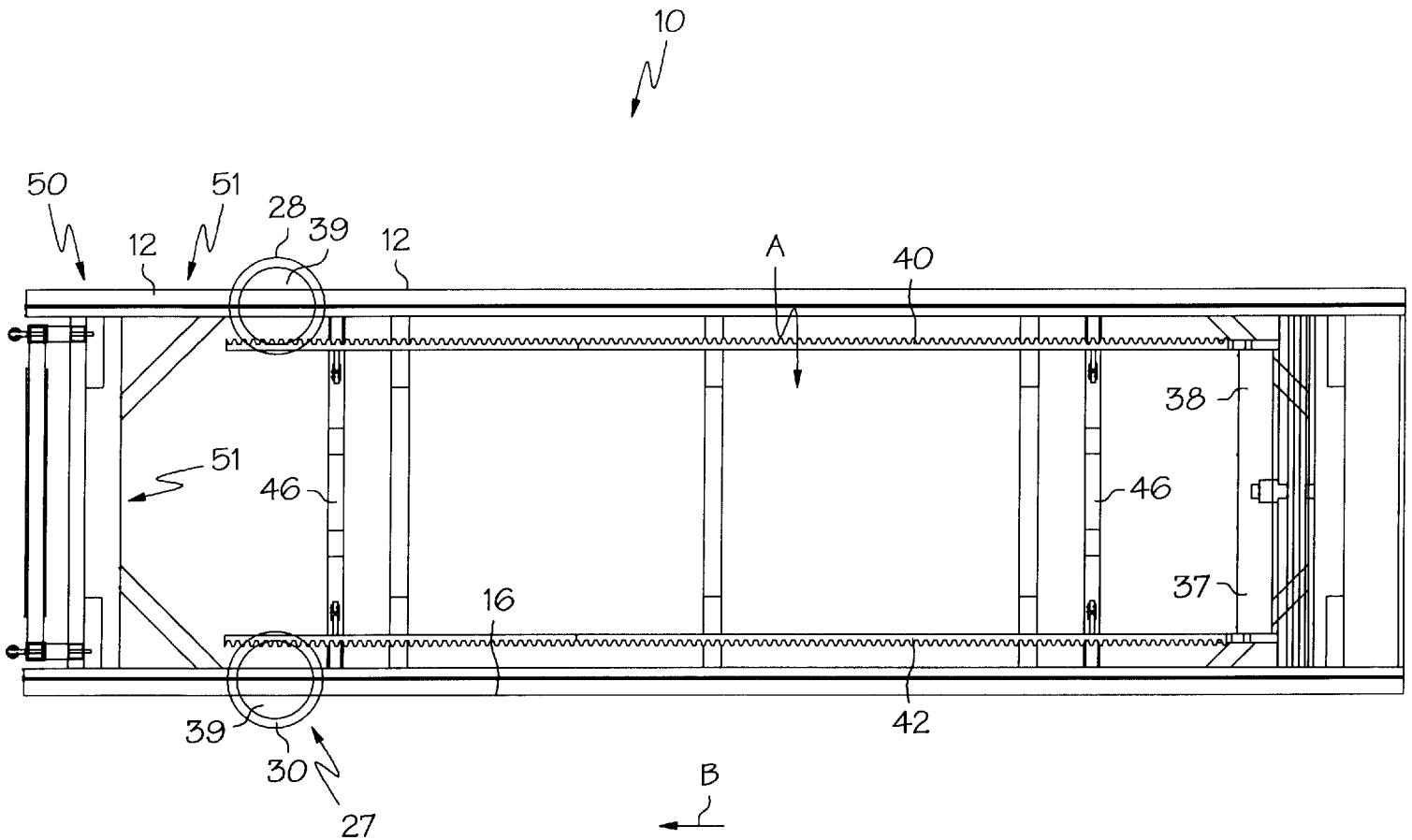
FIG. 7 is a top view of an alternate embodiment of the pipe pusher of the present invention.

In the preferred embodiment, the racks 40, 42 are stationarily coupled to the frame 12, and the motors 28, 30, 32, 34 move downstream along with the pushing element 38. However, in an alternate embodiment of the present invention shown in FIG. 7, the racks 40, 42 are coupled to the pushing element 38 for longitudinal movement, and the motors 28, 30 are stationarily coupled to the frame 12 (only two motor are illustrated in the embodiment of FIG. 7). The motors 28, 30 are preferably located adjacent the distal end 51 of the frame 12. When the pushing element 38 is in the withdrawn position shown in FIG. 7, the racks 40, 42 extends longitudinally within the frame 12, and may be supported and guided by the side rails 14, 16 or other support structure. In order to insert a pipe into the tunnel, the pipe is inserted into the frame 12 at space A between the racks 40, 42. The gears 39 are then rotated by the motors 28, 30, pulling the racks 40, 42 in the downstream direction B, along with the pushing element 38. The pushing element 38 engages the pipe and pushes it into the tunnel, and the racks 40, 42 are moved into the tunnel along with the pipe. Once the pipe is sufficiently pushed into the tunnel, the rotation of the gears 39 is reversed, and the racks 40, 42 and pushing element 38 are moved in the upstream direction. The end bracket 50 and lift bars 44 may be used as described above to position and clamp two pipes for mating.

The frame 12 is preferably made from steel bars, steel pipes or the like. It is important that the frame 12 retain its stiffness in order to ensure that the carriage 36 will move smoothly down the frame, and does not bind. For example, if a first end of the carriage 36 travels faster than the second end, the carriage 36 may bind in the frame. In the illustrated embodiment, the trusses 26 provide the desired stiffness.

Figure 8:
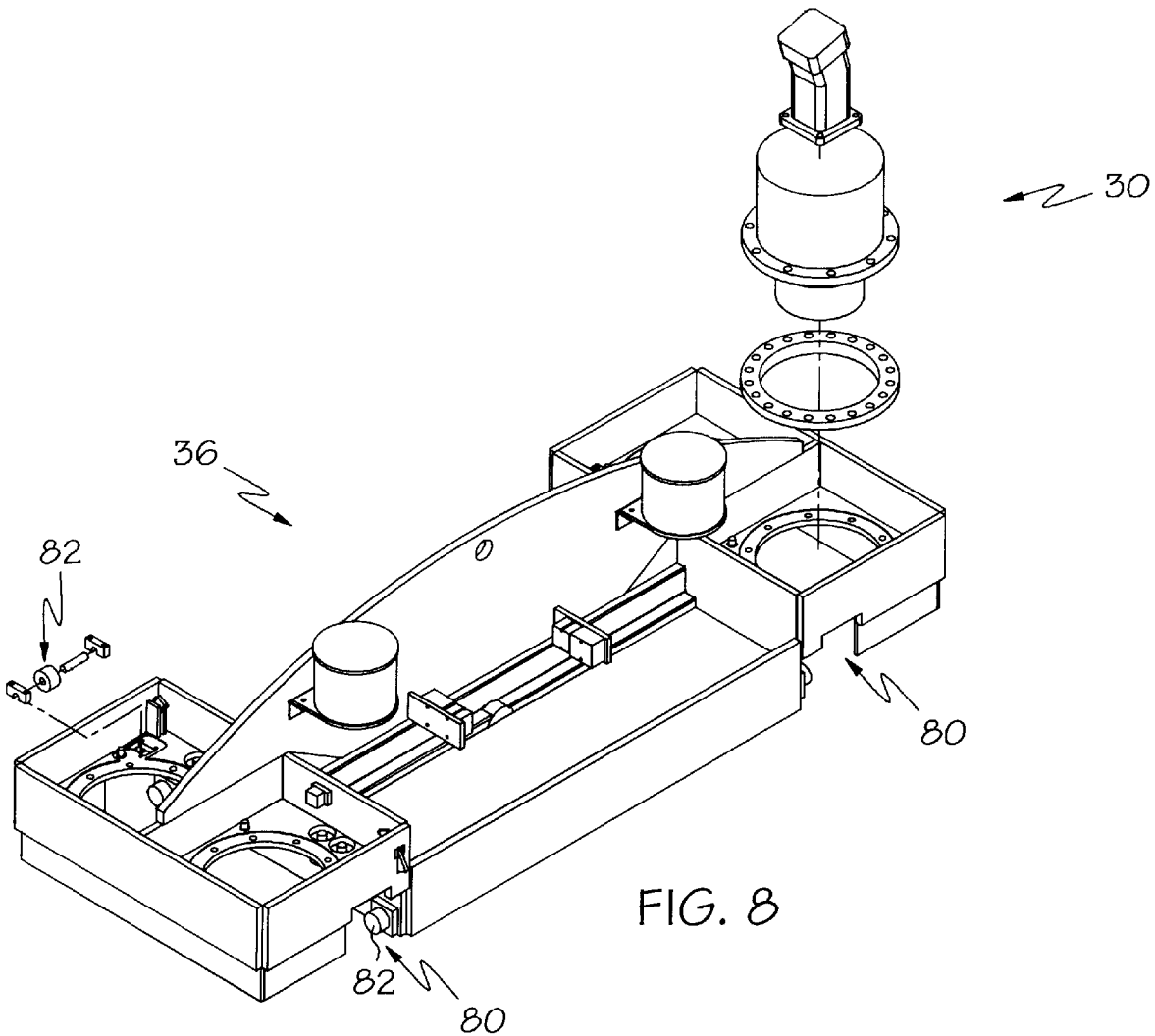
FIG. 8 is a perspective view of the carriage of the pipe pusher of FIG. 1.
Figure 9:
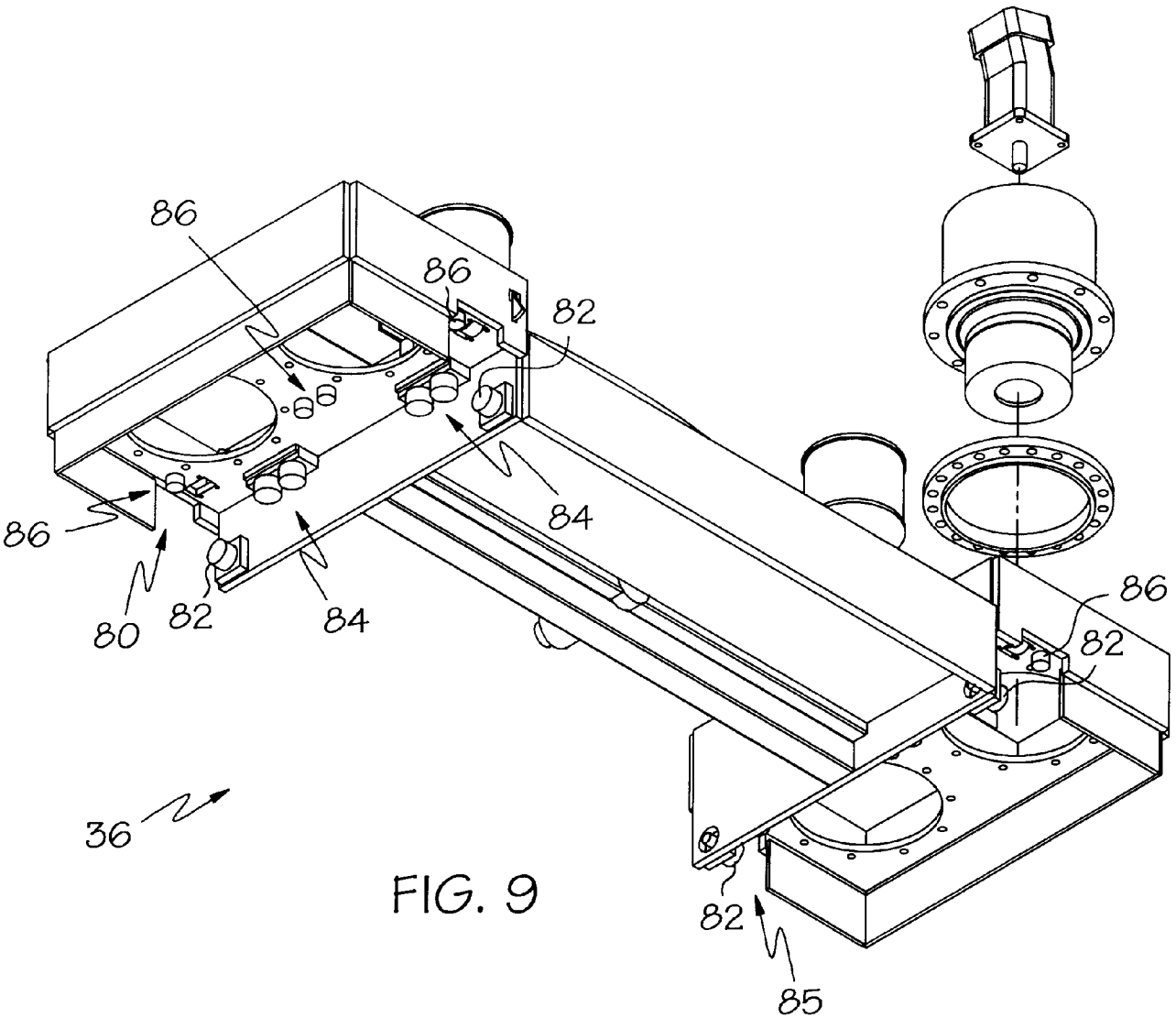
FIG. 9 is another perspective view of the carriage of FIG. 8.

The carriage 36 must also remain properly aligned as it travels down the frame to ensure that it does not bind. As shown in FIGS. 8–9, the carriage 36 includes a pair of notches 80 on either side to receive the side bars 14, 16 as the carriage 36 moves down the frame 12. The carriage 38 includes a pair of idlers 82 that roll along the top of the top of the inner rails 21. A set of second idlers 84 and a set of third idlers 86 ride on either side of the central bar 18 of the side bars 14, 16. The idlers 82, 84, 86 help to retain the alignment of the carriage 36 and may also be replaced with rollers, bearings or other similar mechanisms.

While the forms of the apparatus described herein constitute a preferred embodiment of the invention, the present invention is not limited to the precise forms described herein, and changes may be made therein without departing from the scope of the invention.

What is claimed is:

1. An apparatus for pushing tubular members along a tunnel comprising:

a frame shaped to receive a tubular member therein and having a first open end shaped to receive said tubular member therethrough;

a pushing element mounted on and displaceable along said frame for engaging a tubular member within said frame and pushing said tubular member along said frame and through said first open end;

a drive motor mounted on said pushing element and engaging said frame, said drive motor displacing said pushing element along said frame relative to said first open end; and an end clamp positioned adjacent to said first open end of said frame for retaining a tubular member located substantially downstream of said frame while said tubular member is mated with said downstream tubular member.

2. The apparatus of claim 1 wherein said pushing element and said drive motor are coupled together for displacement along said frame.

3. The apparatus of claim 2 wherein said pushing element includes a carriage for supporting said drive motor and for coupling said drive motor and said pushing element together for displacement along said frame.

4. The apparatus of claim 3 wherein said frame includes a first rack and said drive motor includes a first pinion rotatable by said drive motor and positioned to engage said first rack, whereby rotation of said first pinion causes said drive motor and said pushing element to be displaced along said frame.

5. The apparatus of claim 4 wherein said frame includes a first longitudinally extending side bar and a second longitudinally extending side bar laterally spaced from said first longitudinally extending side bar for receiving said tubular member therebetween.

6. The apparatus of claim 5 wherein said carriage is supported by said first side bar and said second side bar.

7. The apparatus of claim 6 wherein said drive motor includes a first motor including said first pinion, and wherein said drive motor includes a second motor including a second pinion, wherein said apparatus further includes a second rack for receiving said second pinion such that rotation of said second pinion by said second motor causes said pushing element to engage and push said tubular member along said frame.

8. The apparatus of claim 7 wherein said first rack is located on said first side bar and said second rack is located on said second side bar.

9. The apparatus of claim 8 wherein said drive motor includes a third motor having a third pinion received in said first rack, and wherein said drive motor includes a fourth motor having a fourth pinion received in said second rack.

10. The apparatus of claim 1 wherein said pushing element includes a push ring shaped to engage said tubular member.

11. The apparatus of claim 1 wherein said frame is made from steel tubing.

12. The apparatus of claim 1 wherein said frame includes a second open end opposite said first open end, and wherein said pushing element is displaceable toward said second open end such that a tubular member may be displaced along said frame and through said second open end.

13. The apparatus of claim 1 wherein said frame includes a second open end opposite said first open end, wherein apparatus can receive a tubular member in said frame when said drive motor is located adjacent either said first open end or said second open end.

14. The apparatus of claim 1 wherein said frame includes a second open end opposite said first open end, and wherein said tubular member may be displaced through either said first open end or said second open end.

15. The apparatus of claim 1 further comprising a lift bar mounted on said frame for vertically positioning an end of said tubular member relative to said frame.

16. The apparatus of claim 15 wherein said lift bar extends transversely of said frame.

17. The apparatus of claim 15 wherein said lift bar is vertically adjustable relative to said frame.

18. The apparatus of claim 17 wherein said lift bar includes a motor for providing said vertical adjustment.

19. The apparatus of claim 18 wherein said motor includes a hydraulic cylinder.

20. The apparatus of claim 1 wherein said end clamp includes top and bottom portions, at least one of said top portion and bottom portions being vertically displaceable relative the other to releasably clamp said downstream tubular member therebetween.

21. The apparatus of claim 20 wherein said top portion includes a flange to enable said end clamp to clamp tubular members of varying size.

22. The apparatus of claim 20 wherein said top portion and said bottom portion include generally arcuate gripping surfaces shaped to receive said downstream tubular member.

23. The apparatus of claim 1 wherein said pushing element engages a first end of said tubular member.

24. The apparatus of claim 1 wherein said tubular member is a pipe.

25. The apparatus of claim 1 wherein said pushing element includes a plurality of rollers mounted thereon engage said frame to guide the displacement of said pushing element along said frame.

26. The apparatus of claim 1 wherein said frame includes a plurality of trusses mounted thereon to add stiffness to said frame.

27. The apparatus of claim 1 wherein said frame is shaped to closely receive a tubular member therein to guide said tubular member when said pushing element engages and pushes said tubular member along said frame.

28. The apparatus of claim 1 wherein said frame includes at least one bottom support member that supports said tubular member when said pushing element engages and pushes said tubular member along said frame.

29. The apparatus of claim 1 wherein said pushing element includes a front face that is shaped and located to abut against said tubular member when said pushing element pushes said tubular member along said frame.

* * * * *